US006675697B1

(12) United States Patent
Kleinedler et al.

(10) Patent No.: US 6,675,697 B1
(45) Date of Patent: Jan. 13, 2004

(54) INCLINED PLATE FOR AXIAL PISTON MOTORS

(75) Inventors: Peter Kleinedler, Dubnica nad Vahom (SK); Emilia Kapitanciková , Martin (SK); Lubomir Kanis, Turcianske Teplice (SK)

(73) Assignee: Apis Energy GmbH, Düsseldorf (DE)

( * ) Notice: Subject to any disclaimer, the term of this patent is extended or adjusted under 35 U.S.C. 154(b) by 0 days.

(21) Appl. No.: 09/527,937

(22) Filed: Mar. 16, 2000

Related U.S. Application Data

(63) Continuation of application No. PCT/IB98/01943, filed on Dec. 7, 1998.

(51) Int. Cl.[7] ..... F01B 3/00
(52) U.S. Cl. ..... 92/71; 74/60
(58) Field of Search ..... 92/71, 57; 74/60; 91/499

(56) References Cited

U.S. PATENT DOCUMENTS

| | | | | | |
|---|---|---|---|---|---|
| 2,386,675 | A | * | 10/1945 | Ford | 74/60 |
| 2,733,666 | A | | 2/1956 | Poulos | |
| 2,913,911 | A | * | 11/1959 | Gilkey | 74/60 |
| 2,944,430 | A | * | 7/1960 | Huber | 74/60 |
| 3,082,697 | A | * | 3/1963 | Lucien | 74/60 |
| 3,156,192 | A | * | 11/1964 | Austin et al. | 74/60 |
| 3,202,101 | A | | 8/1965 | Tinker et al. | |
| 3,361,077 | A | * | 1/1968 | Freeman | 74/60 |
| 3,691,910 | A | * | 9/1972 | Reichel et al. | 74/60 |

FOREIGN PATENT DOCUMENTS

| | | |
|---|---|---|
| DE | 1955765 | 2/1967 |
| DE | 1816233 | 7/1969 |
| DE | 3503437 C2 | 8/1986 |
| GB | 822982 | 11/1959 |
| GB | 1158906 | 7/1969 |

* cited by examiner

*Primary Examiner*—Edward K. Look
*Assistant Examiner*—Igor Kershteyn
(74) *Attorney, Agent, or Firm*—Goodwin Procter LLP

(57) ABSTRACT

The invention relates to an axial piston motor having a hollow cylindrical machine housing with an end face and an outer diameter, an inclined plate within the housing, a closing cap for the housing, and a support for the inclined plate integral with the closing cap, the improvement which comprises an outer thread on the support removable meshing with an inner thread on the interior of the machine housing.

5 Claims, 1 Drawing Sheet

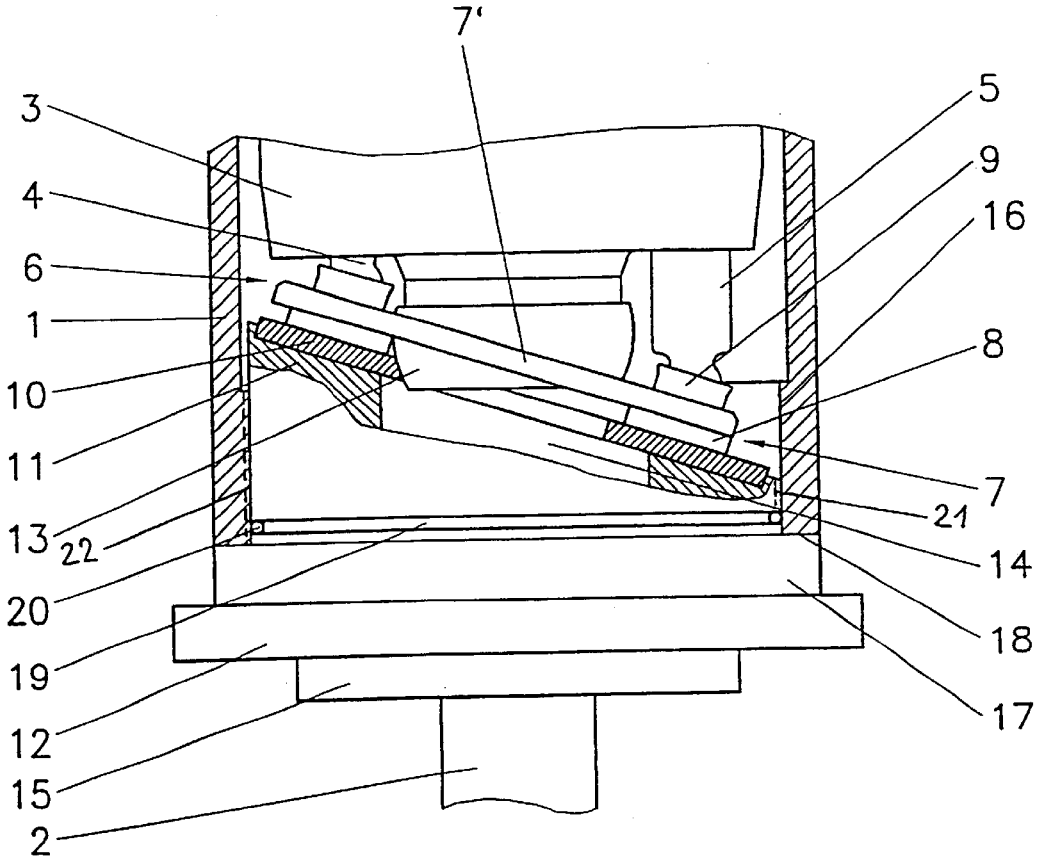
7'
3
5
4
9
16
6
1
8
10
11
7
21
13
22
14
20
18
19
17
12
15
2

INCLINED PLATE FOR AXIAL PISTON MOTORS

This is a continuation of international application No. PCT/IB98/01943, filed on Dec. 7, 1998.

FIELD OF INVENTION

The invention relates to a support for inclined plates of an axial piston motor.

BACKGROUND

In traditional axial piston motors, the closing cap is attached to the support by screws is or connected thereto by some other securing means. This has firstly the disadvantage that high-quality and thus expensive material has to be used both for the closing cap and for the support. A further disadvantage is that the support has to be correctly connected to the closing cap, which entails additional technical outlay and expenditure of time.

An axial piston motor is known from German petty patent No. 1,955,765, in which the closing cap is simultaneously a support for the inclined plate. The closing cap is inserted in the machine housing as a press fit and with a flange, with at least one sealing groove being provided. The closing cap with the inclined plate must, however, be secured to the machine housing by a plurality of screws, so that a correspondingly long assembly time is necessary and additional securing means are required.

It is an object of the invention to create a support in an axial piston motor, which are simpler and cheaper to manufacture, in which assembly times for attaching the support to the axial piston motor are reduced and in which the adjustment of the support can be made with high precision.

BRIEF DESCRIPTION OF THE INVENTION

The invention relates to an axial piston motor having a hollow cylindrical machine housing with an end face and an outer diameter, an inclined plate within the housing, a closing cap for the housing, and a support for the inclined plate integral with the closing cap, the improvement which comprises an outer thread on the support removable meshing with an inner thread on the interior of the machine housing.

According to the invention a support for axial piston motors can be manufactured for an axial piston motor, simply, inexpensively (by casting) and with high precision. Now only those parts of the closing cap and the support which co-operate with other functional parts during operation require finishing.

Adjusting the support in respect of the closing cap is not required. Equally unnecessary are connecting means through which a standard connection between the support and the closing cap can be produced.

BRIEF DESCRIPTION OF THE DRAWING

The invention is described in greater detail below, with reference being had to the sole figure of the drawing showing significant parts of the axial piston motor in cross section.

DETAILED DISCLOSURE

The bearings for a shaft 2 in a cylindrical machine housing 1, are arranged driven by a motor. A cylindrical drum 3 is connected to the motor. This shaft is not shown in the housing 1 to show other parts better. The cylindrical drum 3 is held on the engine shaft to be axially but not radially displaceable. A number of cylinders (not shown) are disposed in the cylindrical drum 3, for example 9, are displaceably arranged in each cylinder. Each piston 4,5 is supported against a slide shoe 6,7 formed respectively of a slide shoe plate, such as slide shoe plate 8, and an integrated slide shoe neck, such as slide shoe neck 9. The slide shoes 6,7 lie with their end face against an inclined plate 10 which is securely connected to a support 11. The slide shoes 6, 7 are held in bores of a hold-down ring 7', the annular inner surface of which communicates with the outer surface of a spring-loaded shaft ring 13 having the shape of a spherical cap. That spherical cap-shaped is non-rotatably disposed on the shaft 2 but is displaceable longitudinally. The slide shoes 6, 7 are pressed onto the inclined plate 10 by that cap.

The support 11 is internally connected with a closing cap 12. This combined closing unit 11, 12 can be cast from one piece. The positioning of the support 10 is thus fixed and does not need to be specially adjusted as in the case of conventional axial piston motors. The closing unit 11, 12 is provided with a central recess 14. The shaft 2 is guided through that central recess. The shaft can be mounted in this closing unit or in a bearing plate 15 which can be secured to this closing unit. The closing unit 11, 12 is inserted on the inner wall 16 of the housing as a press fit and is provided with a flange 17. The surface of the flange facing the housing abuts against the end face of the housing 1 at point 18. A sealing groove 19 on the outer perimeter of the support 11 is provided to receive a seal 20 sealing the support 11 against the housing 1.

The portion of the support 11 projecting into the machine housing 1 has a cylindrical portion which is provided with an outer thread 21 and can be meshed with an inner thread 22 of the machine housing 1. This portion is trapezoidal in axial cross-section. By screwing down the support 11, simultaneously also a correct positioning of the inclined plate 10 is achieved. Since the support 11 is only loaded indirectly, by the inclined plate 10, and is subjected to practically no wear, the support 11 can be manufactured from cheaper material, and as cast iron.

What is claimed is:

1. In an axial piston motor having a hollow cylindrical machine housing with an end face and an outer diameter, an inclined plate within the housing, a closing cap for the housing, and a support for said inclined plate integral with the closing cap, the improvement which comprises an outer thread on said support, said support removably meshing with an inner thread on the interior of said machine housing housing, said outer thread on said support extends over a majority of the distance between said end face and said inclined plate at all circumferential portions of said support.

2. The axial piston motor of claim 1, further comprising a flange having an outer diameter, said flange being disposed between said support and said closing cap, said flange having a surface facing said machine housing with said face abutting against said end face.

3. The axial piston motor of claim 1, wherein said support has a radially outward open sealing groove which is located inside the machine housing when the motor is assembled in operating condition.

4. The axial piston motor of claim 3, wherein said sealing groove is disposed between said inclined plate and said flange.

5. The axial piston motor of claim 2, wherein said outer diameter of said flange is not larger than said outer diameter of said machine housing.

* * * * *